US009890945B2

(12) United States Patent
Lazalier

(10) Patent No.: US 9,890,945 B2
(45) Date of Patent: Feb. 13, 2018

(54) REFLECTOR AND SEALING ASSEMBLY FOR LIGHTING ASSEMBLY

(71) Applicant: HUBBELL INCORPORATED, Shelton, CT (US)

(72) Inventor: Ray M. Lazalier, Lake St. Louis, MO (US)

(73) Assignee: Hubbell Incorporated, Shelton, CT (US)

( * ) Notice: Subject to any disclaimer, the term of this patent is extended or adjusted under 35 U.S.C. 154(b) by 97 days.

(21) Appl. No.: 14/220,655

(22) Filed: Mar. 20, 2014

(65) Prior Publication Data

US 2015/0267910 A1 Sep. 24, 2015

(51) Int. Cl.

| | |
|---|---|
| ***F21V 29/00*** | (2015.01) |
| ***F21V 31/00*** | (2006.01) |
| ***F21V 7/00*** | (2006.01) |
| ***F21K 9/60*** | (2016.01) |
| *F21S 8/08* | (2006.01) |
| *F21V 7/09* | (2006.01) |
| *F21V 7/22* | (2006.01) |
| *F21V 15/01* | (2006.01) |

(Continued)

(52) U.S. Cl.

CPC ..... *F21V 31/005* (2013.01); *F21K 9/60* (2016.08); *F21V 7/0066* (2013.01); *F21S 8/085* (2013.01); *F21V 7/09* (2013.01); *F21V 7/22* (2013.01); *F21V 15/013* (2013.01); *F21V 23/002* (2013.01); *F21W 2111/02* (2013.01); *F21W 2131/10* (2013.01); *F21Y 2105/10* (2016.08); *F21Y 2115/10* (2016.08)

(58) Field of Classification Search

CPC .... F21V 31/005; F21V 7/0066; F21V 7/0083; F21V 2008/006; F21V 7/05; F21V 31/00; F21K 9/50; F21Y 2101/02; G02F 1/133602; F21S 48/33

USPC ..... 362/267; 313/512

See application file for complete search history.

(56) References Cited

U.S. PATENT DOCUMENTS

| | | | | |
|---|---|---|---|---|
| 7,168,825 | B2 * | 1/2007 | McArthur | 362/267 |
| 7,182,627 | B1 * | 2/2007 | Huang | 439/487 |

(Continued)

FOREIGN PATENT DOCUMENTS

| | | |
|---|---|---|
| DE | 202007016530 | 2/2008 |
| EP | 1780804 | 5/2007 |

OTHER PUBLICATIONS

PCT/US2015/021830 International Search Report and Written Opinion dated Jun. 18, 2015.

*Primary Examiner* — Anh Mai
*Assistant Examiner* — Matthew Peerce
(74) *Attorney, Agent, or Firm* — Michael Best & Friedrich, LLP

(57) ABSTRACT

A lighting assembly is provided having a housing supporting a lighting source such as a plurality of LEDs, a reflector having a central opening for the light source, a light transmitting cover and a frame attached to the housing to couple the frame and the light transmitting cover to the housing. The reflector has an outer perimeter with a channel formed in the top face and the bottom face for a continuous seal member. The frame is coupled to the housing to capture the frame and the light transmitting cover between the frame and the housing so that the seal members form a weatherproof seal between the light transmitting cover and the frame and between the frame and the face of the housing.

20 Claims, 4 Drawing Sheets

(51) Int. Cl.

| | |
|---|---|
| *F21V 23/00* | (2015.01) |
| *F21W 111/02* | (2006.01) |
| *F21W 131/10* | (2006.01) |
| *F21Y 105/10* | (2016.01) |
| *F21Y 115/10* | (2016.01) |

(56) References Cited

U.S. PATENT DOCUMENTS

| | | | | |
|---|---|---|---|---|
| 7,710,714 | B2 | 5/2010 | Rapp et al. | |
| 8,025,422 | B1 * | 9/2011 | Huang et al. | 362/241 |
| 8,267,544 | B2 | 9/2012 | Zheng et al. | |
| 8,292,449 | B2 | 10/2012 | Poissonnet et al. | |
| 8,371,729 | B2 | 2/2013 | Sharrah et al. | |
| 8,439,716 | B2 | 5/2013 | Mandrik | |
| 8,511,850 | B2 * | 8/2013 | Hawkins et al. | 362/225 |
| 8,529,085 | B2 | 9/2013 | Josefowicz et al. | |
| 2008/0218993 | A1 * | 9/2008 | Li | F21V 5/00 362/84 |
| 2009/0034247 | A1 * | 2/2009 | Boyer | 362/225 |
| 2010/0165633 | A1 * | 7/2010 | Moolman | F21V 7/0008 362/298 |
| 2010/0328960 | A1 * | 12/2010 | Wang | 362/373 |
| 2011/0063849 | A1 * | 3/2011 | Alexander | F21S 48/328 362/294 |
| 2011/0249427 | A1 * | 10/2011 | Rooms et al. | 362/147 |
| 2012/0057351 | A1 * | 3/2012 | Wilcox et al. | 362/307 |
| 2012/0293980 | A1 * | 11/2012 | Yoshikawa | 362/84 |
| 2014/0071377 | A1 * | 3/2014 | Scardato | 349/58 |
| 2014/0268789 | A1 * | 9/2014 | Boyer et al. | 362/267 |

* cited by examiner

REFLECTOR AND SEALING ASSEMBLY FOR LIGHTING ASSEMBLY

FIELD OF THE INVENTION

The present invention is directed to a lighting assembly having a reflector and a sealing device. In particular, the invention is directed to lighting assembly having reflector capable of forming a seal between the housing and transparent cover or lens of the lighting assembly.

BACKGROUND OF THE INVENTION

Lighting assemblies are constructed to illuminate an area and typically include a housing and a lens, cover or other transparent or translucent member to protect the light source. Exterior lighting assemblies generally require waterproof or weatherproof enclosures to protect the internal components from water and dirt. Gaskets are often used in exterior lighting assemblies between the various components of the housing to protect the internal components.

Many of the current exterior lighting assemblies use LEDs as the light source. The LEDs are commonly mounted on a circuit board that is then mounted in a housing to enclose the circuit board. The housing requires a weatherproof enclosure to protect the circuit board from water and dirt.

Examples housing for use with LEDs are disclosed in U.S. Pat. No. 8,267,544 to Zheng et al. discloses an LED lamp having a circuit board with a transparent cover. A sealing ring as shown in FIG. 3 is received between the circuit board and the transparent cover to form a seal around the printed circuit board between the cover and the housing. The housing and the reflector do not appear to have a channel to receive the seal.

U.S. Pat. No. 8,292,449 to Poissonnet et al. discloses a modular lamp for underwater environments. As shown in FIG. 2, the lamp includes a housing supporting a circuit board and a plurality of LEDs. The housing includes a channel surrounding the circuit board for receiving a seal. The cover includes a frame that is attached to the housing to compress the seal to form a weatherproof seal around the circuit board.

U.S. Pat. No. 8,529,085 to Josefowicz et al. discloses an LED lighting fixture having a main body supporting a circuit board with a plurality of LEDs and a light transmitting cover. The housing has a recess in the housing surrounding the circuit board which forms a seal between the housing and the cover.

While the prior lighting assemblies have been generally suitable for the intended purpose, there is a continuing need in the industry for improved lighting devices.

SUMMARY OF THE INVENTION

The present invention is directed to a lighting assembly having a weatherproof enclosure. The invention is particularly directed to a lighting assembly for use with LEDs and a circuit board where the assembly includes a housing to enclose and support the LEDs and the circuit board and provide a weatherproof enclosure.

One object of the invention is to provide an enclosure for a lighting assembly having a reflector to direct light outwardly from the light source and where the reflector forms a weatherproof seal between the housing and the lens or light transmitting cover.

Another feature of the invention is to provide a lighting assembly that is economical to produce and easy to assemble while providing a weatherproof enclosure to protect the internal components during outside use.

The invention is particularly directed to a lighting assembly having a reflector where the reflector has a seal member on an outer surface for forming a seal between the reflector and the lens or light transmitting cover and a seal member on an inner surface for forming a seal between the reflector and the surface of the housing.

The housing of the lighting assembly is able to provide a weatherproof enclosure for the light source and drivers or other electrical components using the reflector to support the gasket member during assembly without the need to modify the housing or the lens to accommodate the seal member and the reflector.

The invention is suitable for a lighting assembly having an extruded or continuous molded metal housing that requires minimal machining after extrusion. The extruded housing has a substantially flat mounting surface for the LED array and circuit boards. The reflector is able to form a waterproof or weatherproof enclosure around the LED array and circuit board with the need to modify the housing. In other embodiments, other forms of housings and construction can be used. In one embodiment, the housing can be made from sheet metal that is cut and folded to the desired form.

In one embodiment of the invention, the reflector has an outer surface with a channel surrounding the perimeter and a continuous gasket or seal member received in the recess to form a seal between the reflector and the inner surface of a lens. The bottom surface of the reflector has a continuous recess around the perimeter receiving a continuous seal member for forming a seal between the reflector and the outer face of the housing.

The reflector of the invention is a one-piece member having a continuous side wall that surrounds the light source. An inner face mates with the housing and an outer face mates with a light transmitting cover member to form a weatherproof seal around the light source. Typically the reflector is made of a molded plastic material.

These and other aspects and advantages of the invention are basically attained by providing a lighting assembly having a heat conducting housing with a top face for dissipating heat and a bottom face, a circuit board coupled to the housing, a light transmitting cover, and frame for coupling the light transmitting cover and the reflector to the housing. The circuit board having a plurality of LEDs mounted thereon is coupled to the bottom face of the housing to transfer heat to the base. The reflector has a central opening surrounding the circuit board and the LEDs for reflecting light away from the LEDs. The reflector has a bottom face with a continuous channel circumscribing a perimeter of the bottom face of the reflector and a top face with a continuous second channel circumscribing said perimeter of said reflector. A first continuous seal member is mounted in the first channel and surrounds the perimeter and the central opening to form a seal between the reflector and the housing. A second continuous seal member is mounted in the second channel and surrounds the perimeter and the central opening. A transparent cover is mounted to the housing to overlie the front face of the reflector so that the second seal member forms a seal between the reflector and the transparent cover. A reflector frame is coupled to the housing to attach the reflector and transparent cover to the housing.

The features of the invention are further attained by providing a lighting assembly having a housing, a reflector, a first seal member, a transparent cover, a second seal and the reflector frame. The housing has a mounting face with a circuit board coupled to the front face. The circuit board has a plurality of LEDs mounted thereon. The reflector is mounted to the mounting face of the housing and has an inner face contacting the mounting face of the housing and an outer face opposite the inner face, and a central opening extending between the outer face and the inner face to surround the LEDs. The first seal member surrounds the central opening and is positioned between the inner face of the reflector and the mounting face of the housing to form a weatherproof seal. The transparent cover overlies the outer face of the reflector and the central opening. The second seal is positioned between the transparent cover and the outer face of the reflector. The frame overlies the transparent cover and has a central opening aligned with the LEDs where the frame is coupled directly to the housing for coupling the reflector and cover to the housing and forming a weatherproof seal between the transparent cover and the frame.

The various features of the invention are further attained by providing a lighting assembly comprising a housing, a circuit board attached to the housing, a reflector, a light transmitting cover, and a frame. The housing is made from a heat conducting material and has a mounting face. The circuit board has a plurality of LEDs mounted thereon where the circuit board is coupled to the mounting face for transferring heat to the housing. The reflector is coupled to the mounting face of the housing and has a central opening for receiving the LEDs and an outer rim surrounding the central opening. An inner top face of the reflector contacts the mounting face of the housing to form a seal between the mounting face of the housing and the reflector. An outer bottom face of the reflector forms a seal between the outer bottom face of the reflector and the light transmitting cover. The light transmitting cover overlies the reflector and the LEDs. The frame has an inwardly extending flange with an inner edge forming a central opening and overlying an outer surface of the cover. An outwardly extending flange is coupled to the housing to couple the frame and cover to the housing.

These and other aspects, objects and features of the invention will become apparent from the annexed drawings and the following detailed description of the invention, which disclose various embodiments of the invention.

BRIEF DESCRIPTION OF THE DRAWINGS

The following is a brief description of the invention in which.

DETAILED DESCRIPTION OF THE INVENTION

Figure 1:
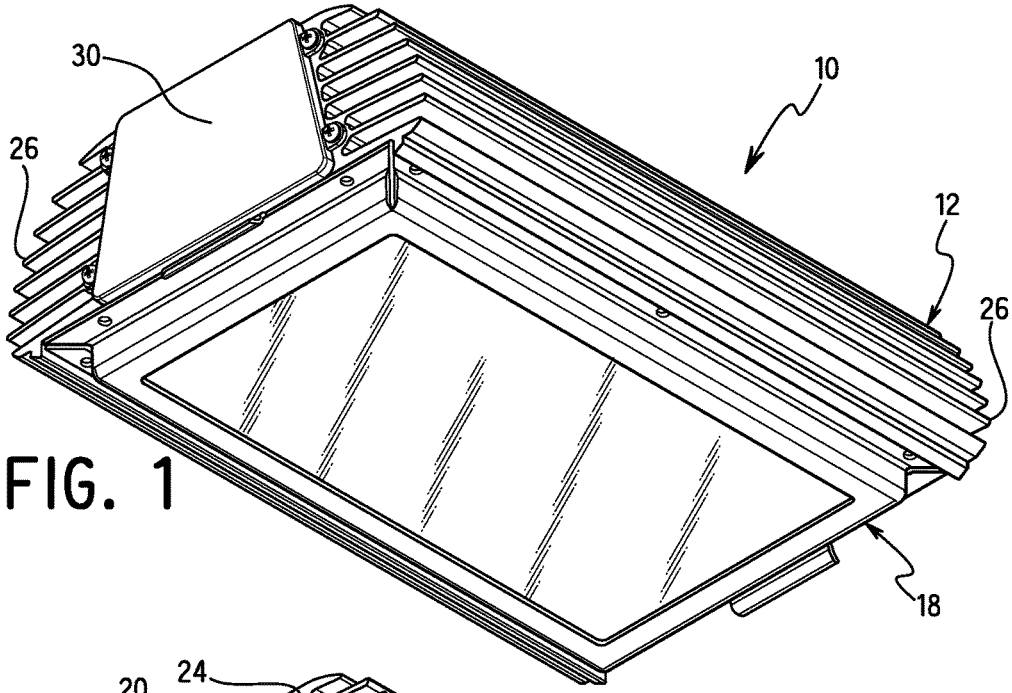
FIG. 1 is a bottom perspective view of the lighting assembly in one embodiment of the invention.

The present invention is directed to a lighting assembly having a weatherproof enclosure. The invention is particularly directed to a lighting assembly for use with LEDs and a circuit board where the assembly includes a housing to enclose and support the LEDs and the circuit board and provide a weatherproof enclosure.

The lighting assembly in the embodiment shown is adapted for exterior use such as a floodlight to illuminate an area. The lighting assembly can be mounted to various supports and oriented to direct the light to a selected target area.

Referring to the drawings, the lighting assembly 10 includes a housing 12, a reflector 14, a transparent cover 16, and a reflector frame 18. The housing 12 is constructed for supporting a lighting source and for mounting to a support structure such as a pole for directing light to a selected area.

In the embodiment shown, the housing 12 has a top wall 20, a bottom wall 22, and opposite side walls 24. The side walls 24 are provided with a plurality of longitudinally extending cooling fins 26 for dissipating heat and protecting the electrical components. In one embodiment of the invention, the fins 26 extend the length of the housing and project outwardly a distance to provide sufficient cooling and heat dissipation to prevent overheating of the electrical components.

Figure 2:
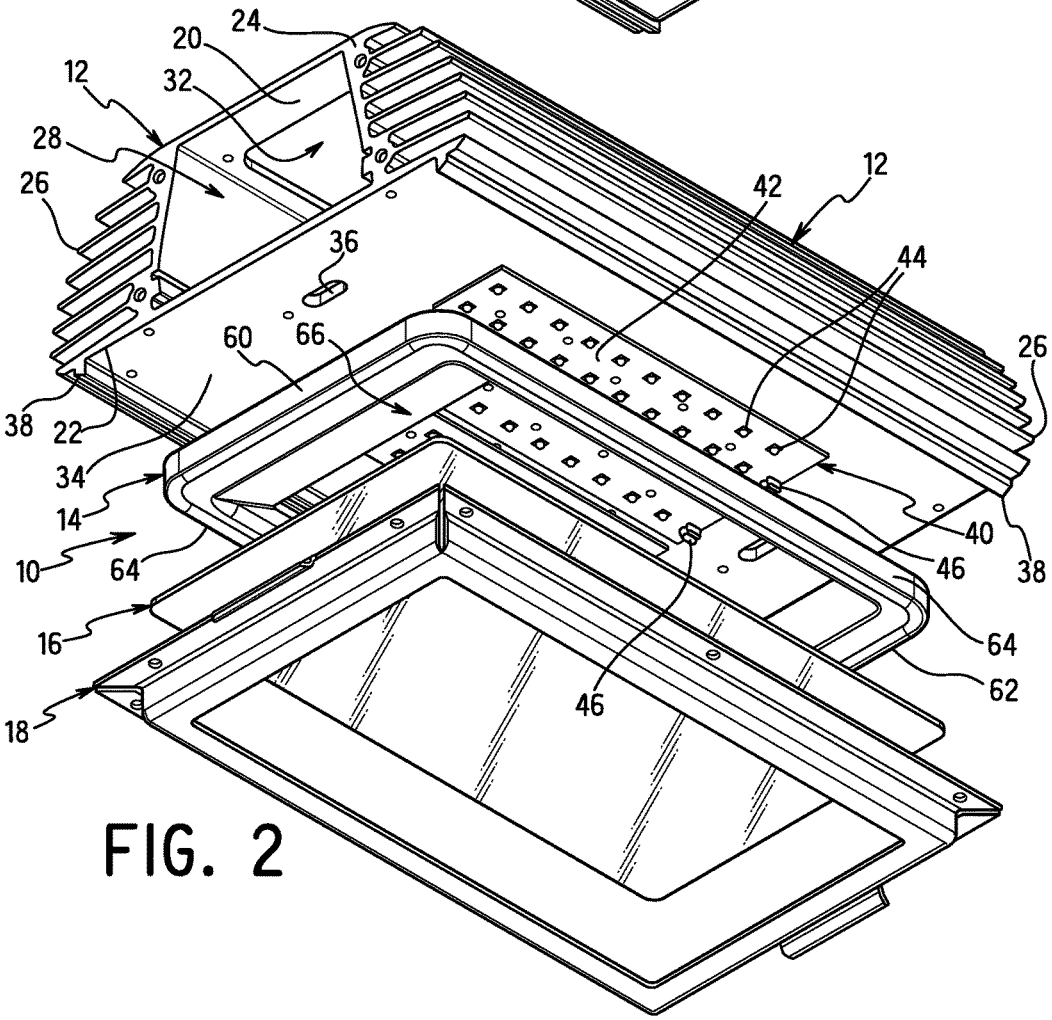
FIG. 2 is an exploded view of the lighting assembly of FIG. 1.
Figure 3:
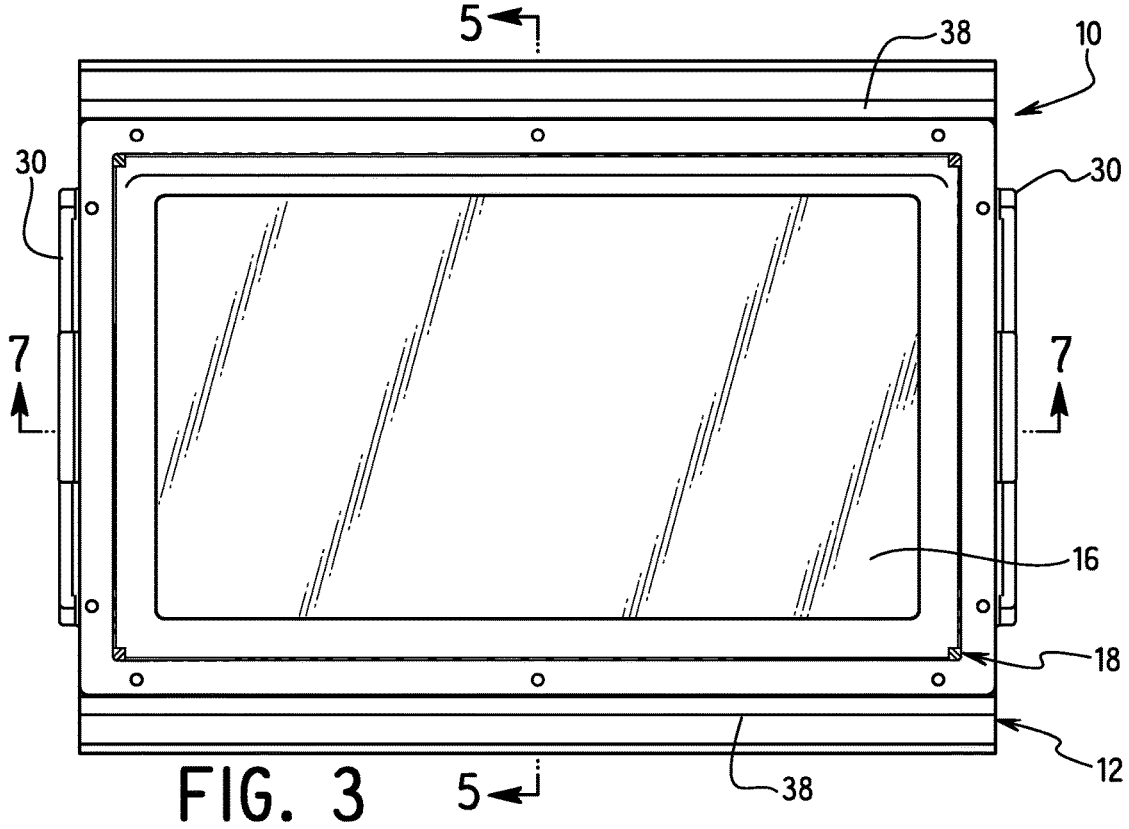
FIG. 3 is a bottom view of the lighting assembly.
Figure 4:
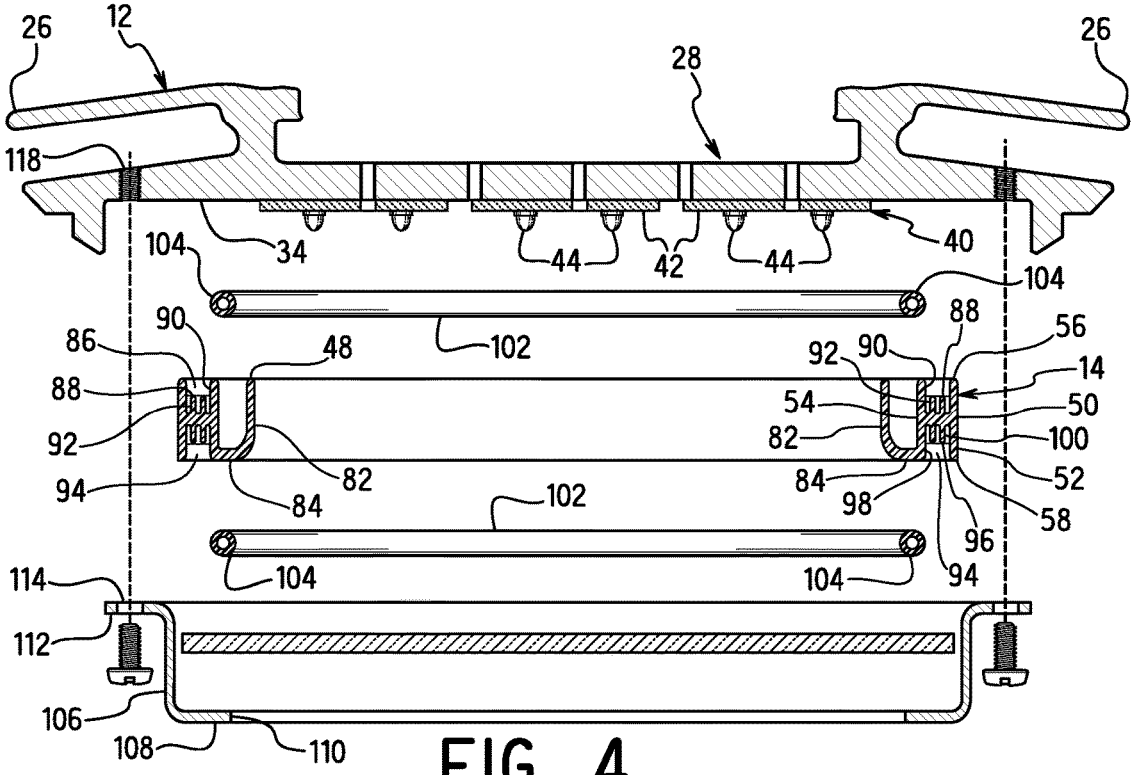
FIG. 4 is an exploded view in cross section of the lighting assembly.

As shown in FIG. 2, the housing 12 has a hollow interior 28 for receiving various electrical components and drivers for the lighting assembly. End caps 30 are coupled to the opposite ends of the housing 12 to enclose the interior cavity 28 and the electrical components. As shown in FIGS. 1 and 2, the end caps 30 are coupled to the longitudinal ends of the housing 12 by screws threaded into screw holes formed in the ends of the housing. An adjustable mounting bracket or yoke can be coupled to the end caps 30 to position the assembly with respect to a support and direct the light to a selected area. The top wall 20 has an opening 32 for accessing the interior cavity of the housing which is closed by a suitable cover (not shown).

In the embodiment shown, the housing 12 is preferably made of aluminum or other heat conducting material by extrusion molding process or other molding process as known in the art. The extrusion molded housing provides a cost effective means for producing the housing with various lengths and to form continuous longitudinal surfaces that extend the length of the housing. In other embodiments, the housing can be constructed from sheet metal or other materials as known in the art that are suitable for making a housing for an electrical lighting assembly.

The bottom wall 22 of the housing 12 in the embodiment shown has a substantially flat mounting surface 34. The mounting surface 34 preferably extends the full-length and width of the bottom wall 22 and has a substantially planar surface area for supporting a lighting source. In the embodiment shown, the mounting surface 34 is substantially flat and planar corresponding to the dimensions of the bottom wall 22. Openings 36 are provided at the opposite longitudinal ends of the mounting surface 34 for supplying electrical wires and connectors to the lighting source. As shown in FIGS. 1 and 2, the longitudinal side edges of the bottom wall 22 include an outwardly extending cooling fin 38 that extends substantially perpendicular to the plane of the mounting surface 34.

The lighting source 40 in the embodiment shown is a circuit board 42 having a plurality of LEDs 44 mounted thereon to form an array. A connector 46 is provided at the end of each of the circuit boards 42 for connecting the LEDs to a driver or power source mounted within the interior cavity 28 of the housing 12. The LED drivers mounted within the housing can be a conventional driver an electrical components as known in the art for actuating the LEDs. The LED array 44 is mounted on the circuit board 42 to project the light away from the plane of the circuit board 42 and the mounting surface 34.

In the embodiment shown, the circuit board 42 for each the lighting source 40 is substantially planar and has a dimension to mount directly to the mounting surface 34 of the housing 12. The circuit boards 42 can be attached to the mounting surface 34 by a suitable adhesive, fastener or other fastening means as known in the art. The number of LEDs mounted to the circuit board can vary depending on the properties and characteristics of the circuit board, the power source and the amount of light intended to be produced by the lighting assembly. In the embodiment shown, three circuit boards are mounted on the mounting surface although the number can vary as needed. The circuit boards are mounted by a suitable means to transfer heat to the housing to prevent overheating of the LEDs and circuit board.

The reflector 14 has a length and width to complement the dimensions of the mounting surface 34 of the housing 12. The reflector in one embodiment of the invention is a molded plastic material such as polycarbonate. The reflector 14 is preferably a one piece integrally formed unit.

The reflector 14 has a central opening 48 with a dimension complementing the dimensions of the circuit board 42 and the corresponding LEDs so that the central opening 48 surrounds the circuit boards 42 of the light source 40. In the embodiment shown, the reflector 14 has a substantially rectangular shape and the central opening 48 has a substantially rectangular shape complementing the rectangular dimensions of the housing 12, the mounting surface 34, and the LED array.

Figure 5:
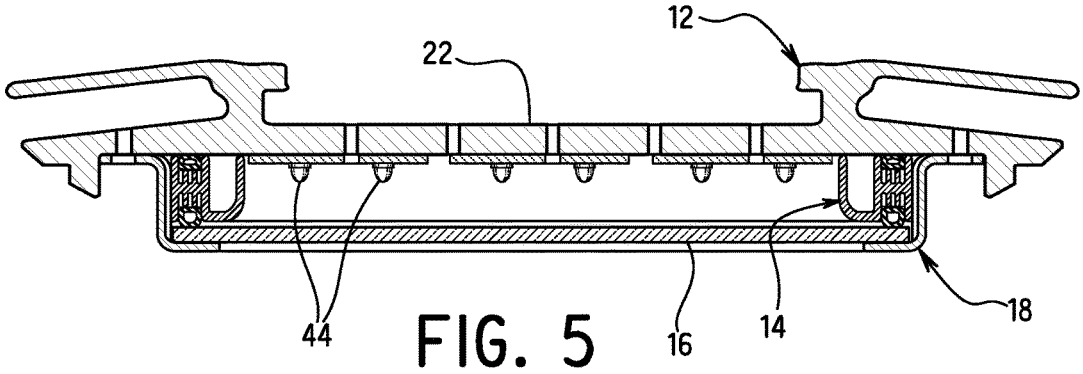
FIG. 5 is cross-sectional view of the lighting assembly taken along line 5-5 of FIG. 3.

The reflector 14 is formed by a continuous outer radial wall 50 having an outer radial surface 52 and an inner radial surface 54. The outer wall 50 forms a perimeter of the reflector 14 and encircles the central opening 48 and defines the outer dimensions of the reflector. The outer wall 50 has an inner surface 56 configured for contacting the mounting surface 34 as shown in FIG. 5. An outer face 58 is provided opposite to the inner face 56. The outer surface 52 and the inner surface 54 of the outer wall 50 extend between the inner face 56 and the outer face 58. In the embodiment shown, the inner face 56 and the outer face 58 are substantially parallel to each other and substantially perpendicular to the outer surface 52 of the outer wall 50.

Figure 6:
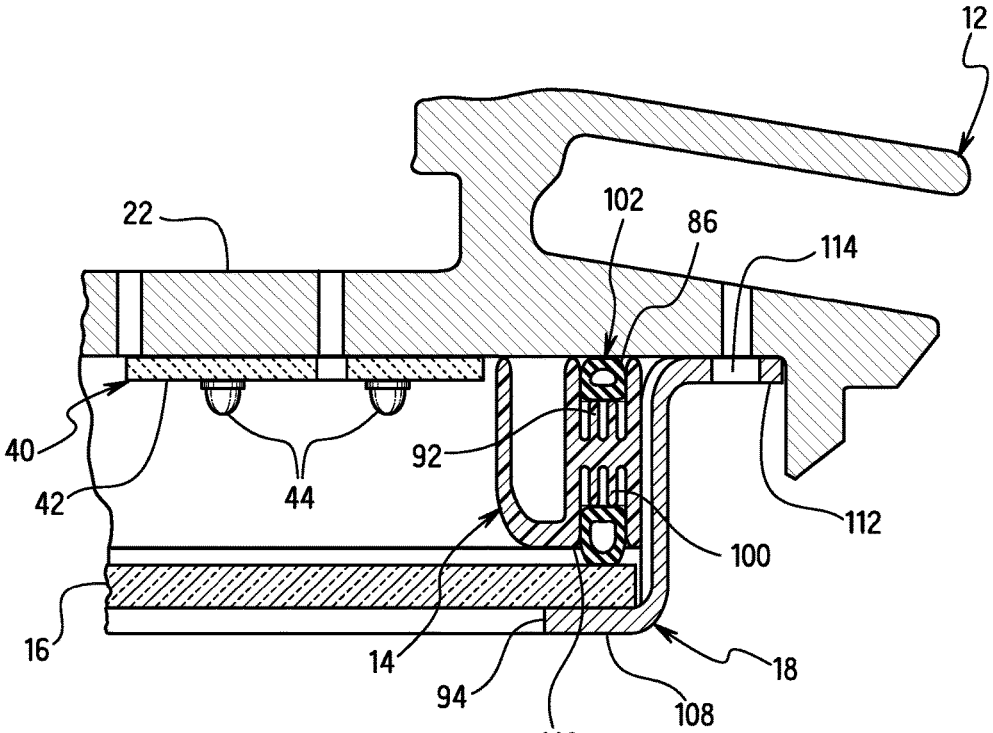
FIG. 6 is an enlarged partial cross-sectional view of the side wall of the reflector and seal.

The outer wall 50 in the embodiment shown is defined by a first end wall portion 60, a second end wall portion 62, and side wall portions 64 extending between the end wall portion 60 and 62. A light reflecting flange 66 extends inwardly from the outer wall 50 and has an inner edge 68 defining the central opening 48. The light reflecting flange 66 as shown in FIG. 6 has an inwardly extending planar portion 70 along the first end wall portion 60 that extends inwardly from the outer face 58 toward the central opening 48 in a direction substantially parallel to the outer face 58. An inclined portion 72 extends from the planar portion 70 and is inclined toward central opening 48 and annular face 56 and extends a distance to contact the mounting surface 34 when mounted on the mounting surface.

Figure 7:
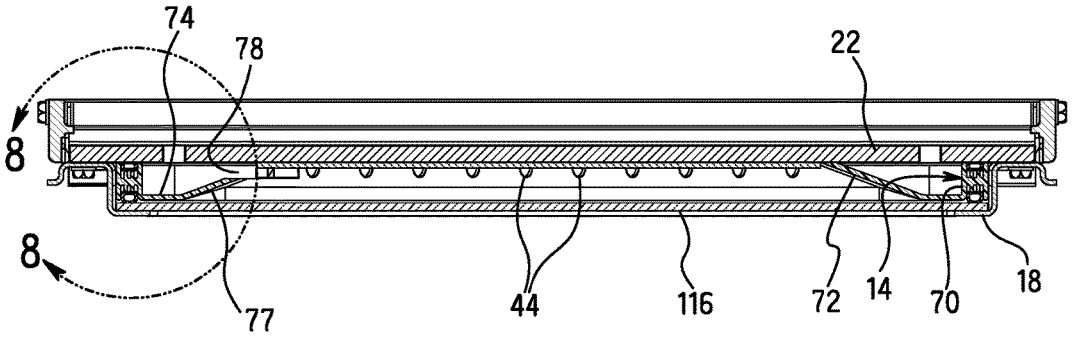
FIG. 7 is a cross-sectional view of the lighting assembly taken along line 7-7 of FIG. 3.
Figure 8:
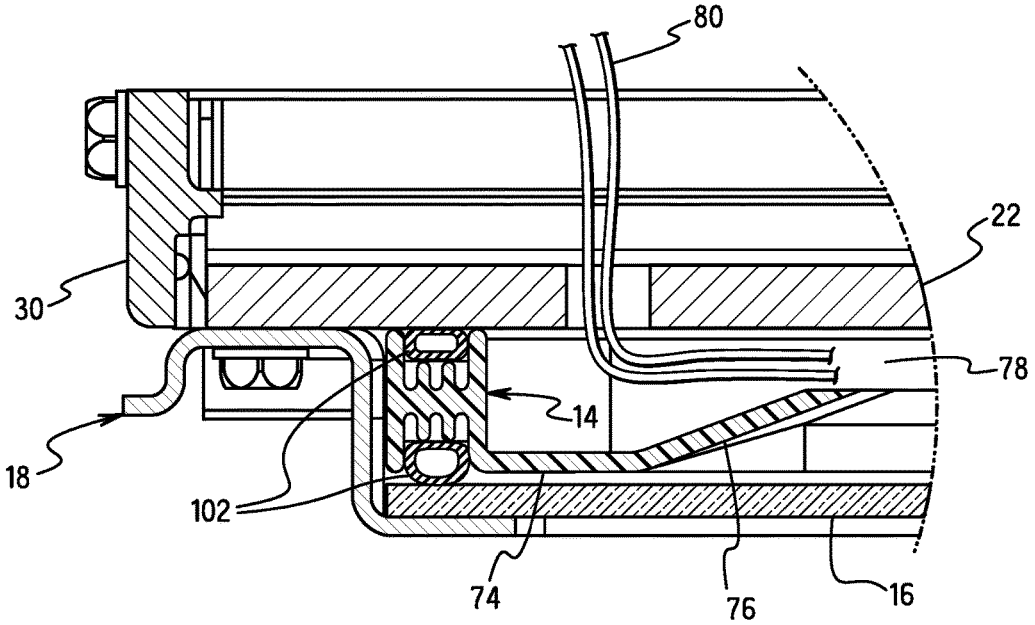
FIG. 8 is an enlarged partial cross-sectional view of the end wall of the reflector and seal.

The reflecting flange 66 includes an inwardly extending portion 74 extending from the end wall portion 62 as shown in FIG. 7. An inclined portion 76 extends from the planar portion 74 and is inclined towards the central opening 48 and the inner face 56. As shown in FIG. 7, the inclined portion 76 has a length to define a gap 78 between the edge of the inclined portion 76 to allow the wires 80 to pass between the opening in the mounting surface 34 and the connector of the circuit board 42. The light reflecting flange 66 has side portions 82 extending substantially parallel to the plane of the outer wall 50 and spaced inwardly from the outer wall 50 by a connecting portion 84. The side portions extend between the inclined portions 72 and 76.

The inner face 56 of the reflector 14 includes a continuous open channel 86 that surrounds the perimeter of the outer wall 50. The channel 86 is defined by a cavity with an open end, a bottom surface 88 and opposing side surfaces 90. At least one rib 92 extends into the cavity of the channel 86 toward the open end as shown in FIG. 5. In the embodiment shown, two continuous ribs 92 extend from the bottom surface 88 so that the ends are spaced inwardly from the inner face 56 and the open end of the channel 86.

The outer face 58 includes an open continuous channel 94 that encircles the perimeter of the outer face and the reflector. The channel 94 has an open end facing opposite the open end of the channel 86 in the inner face 56. The channel 94 is defined by a cavity with has an open end, a bottom surface 96 and side surfaces 98. A rib 100 extends from the bottom surface 96 toward the open end so that the end of the rib is spaced from the open end and the outer face 58. In the embodiment shown, two parallel ribs 100 extend from the bottom surface 96.

A seal member 102 is received in each of the channels 86 and 94. The seal member 102 forms a gasket to form a weatherproof seal between the reflector 14 and the housing 12 and between the reflector 14 and the cover 16. The seal member 102 is a continuous one piece seal that is received in the respective channel and surrounding the perimeter of the reflector along the inner face and the outer face. In the embodiment shown, the seal member has an annular or circular cross section with a hollow center 104 to allow the seal member 102 to compress, deform and form a seal between the opposing surfaces. The seal member 102 has a dimension to fit within the respective channels 86 and 94 and is sufficiently compressible to form a seal with the ribs 92 and 100 and the mounting surface 34 and the surface of the cover 16, respectfully. In the embodiment shown, the inner face 56 and the outer face 58 are substantially parallel and face in opposite directions. The respective channels 86 and 94 also face outwardly from the plane of the reflector 14 in opposite directions. The cover 16 is supported by the reflector 14 so that cover does not directly contact the housing 12.

The cover 16 is a light transmitting member in the form of a transparent or translucent plate-like member having a dimension corresponding to the outer dimension of the reflector 14 so that the cover 16 contacts the outer face 58 of the reflector 14. As shown in FIGS. 5-7, the cover is spaced from the LED array by the reflector. In the embodiment shown, the cover 16 has a substantially planar configuration with a flat inner surface and a flat outer surface for transmitting light from the light source outwardly from the lighting assembly. In other embodiments, the cover 16 can be a lens and provided with a textured surface to defuse light or project light in a desired pattern as known in the art. The cover 16 has a dimension to overlie the LED array to protect the LEDs and circuit boards while transmitting the light to the target area.

The frame 18 is constructed for coupling directly to the housing 12 as shown in FIG. 5. The frame 18 has a continuous side wall 106 with an inner dimension corresponding to the outer dimension of the reflector so that the frame encircles the perimeter of the reflector. In a preferred embodiment, the side wall 106 of the frame 18 has a height corresponding to the combined height of the reflector and the cover. An inwardly extending flange 108 extends radially inward from the outer end of the side wall 106 a distance to overlie an outer edge along a perimeter of the cover 16 and has an inner edge defining a central opening 110 of the frame 18. An inner end of the side wall 16 has an outwardly extending flange 112 for mating with the housing and coupling the frame to the housing. In the flange 112 includes a plurality of screw apertures 114 for receiving a screw 116 for coupling to a threaded aperture 118 in the housing for coupling the frame 18 to the housing. The central opening 110 has a dimension complementing the dimension of the LED array and the frame 18.

The lighting assembly 10 is constructed by positioning the seal members 102 in the respective channels of the reflector 14 and positioning the reflector on the mounting surface 34 of the housing so that the reflector and seal member surround the circuit board 42 and the respective LED array 44 so that the LED array 44 is positioned within the central opening of the reflector 14. The cover 16 is positioned on the outer face 58 of the reflector 14 and the frame 18 is positioned over the cover 16 and secured to the housing. The frame 18 is coupled to the housing by the screws 116 so that the outwardly extending flange 112 apply sufficient pressure to the cover 16 to compress the seal members 102 and form a weatherproof seal between the inner face 56 of the reflector and the mounting surface 34 of the housing 12 and a weatherproof seal between the outer face 58 of the reflector 14 and the inner surface of the cover 16. In one embodiment, the cover 16 can be coupled to the frame 18, such as by a double face adhesive tape, for use in assembly the cover and the frame to the housing.

In the lighting assembly of the invention, the seal members 10 to form a continuous seal around the perimeter of the inner face 56 and outer face 58 of the reflector 16 so that additional seals and gaskets are not necessary to provide a waterproof or weatherproof enclosure for the electrical components of the LEDs and circuit boards.

While various embodiments have been chosen to illustrate the invention, it will be understood by those skilled in the art that various changes and modifications can be made without departing from the scope of the invention as defined in the appended claims.

What is claimed is:

1. A lighting assembly comprising:

a housing having a surface for dissipating heat and a mounting surface;

a circuit board having a plurality of LEDs forming an array mounted thereon, said circuit board being coupled to said mounting surface of said housing for transferring heat to said housing;

a reflector having a central opening and surrounding said circuit board and LEDs for reflecting light outwardly from said lighting assembly, said reflector having an inner face with a first continuous channel circumscribing a perimeter of said reflector, and an outer face with a second continuous channel circumscribing a perimeter of said reflector;

a first continuous seal member mounted in said first channel and surrounding the perimeter of the inner face, said first seal member forming a seal between said inner face of said reflector and said housing, wherein said first channel includes a first rib;

a light transmitting cover overlying said outer face of said reflector; and a second continuous seal mounted in said second channel and surrounding the perimeter of the outer face, said second seal forming a seal between said light transmitting cover and said outer face of said reflector, wherein said second channel includes a second rib, wherein the second rib extends away from the first rib.

2. The lighting assembly of claim 1, further comprising a frame coupled to said housing and attaching said reflector and light transmitting cover to said housing, said frame having a central opening aligned with said light transmitting cover.

3. The lighting assembly of claim 2, wherein said reflector is an integrally formed one-piece member, and where said reflector has a light reflecting surface extending inwardly with respect to said central opening.

4. The lighting assembly of claim 3, wherein said reflector has an inner edge forming said central opening and an outer side surface opposite said inner edge, a first end, and a second end, wherein said light reflecting surface has a first inclined surface extending from said inner edge at said first end and a second inclined surface extending from said second end.

5. The lighting assembly of claim 4, wherein said light reflecting surface has a first side surface and a second side surface extending between said first end and said second end substantially perpendicular to the plane of said reflector.

6. The lighting assembly of claim 5, wherein said first rib extends into a cavity of said channel for contacting said first seal member;

said second rib extends into a cavity of said second channel for engaging said second seal member.

7. The lighting assembly of claim 6, wherein said first seal member has a substantially circular cross-section with a diameter to form a seal between said inner face said reflector and said housing, and said second seal member has a substantially circular cross-section with a diameter to form a seal between said outer face of said reflector and said cover.

8. The lighting assembly of claim 1, wherein said frame has a bottom edge with an outwardly extending flange for coupling to said housing, and a top edge with an inwardly extending flange overlying an edge of said cover to capture said cover and couple said cover to said housing.

9. A lighting assembly comprising:

a housing having a mounting surface;

a circuit board having a plurality of LEDs forming an LED array mounted thereon, said circuit board being coupled to said mounting surface of said housing;

a reflector mounted on said mounting surface of said housing, said reflector having an inner face contacting said mounting surface of said housing and an outer face opposite said inner face, and a central opening extending between said inner face and outer face to surround said LED array;

a first seal member surrounding said central opening of said reflector and positioned in a first channel between said inner face of said reflector and said housing to form a weatherproof seal, said first channel including a first rib;

a light transmitting cover overlying said outer face of said reflector and said central opening;

a second seal positioned in a second channel between said cover and said outer face of said reflector, said second channel includes a second rib, wherein the second rib extends away from the first rib; and a frame overlying said cover and having a central opening aligned with a said LED array, said frame coupled directly to said housing for coupling said reflector and said cover to said housing.

10. The lighting assembly of claim 9, wherein said inner face of said reflector has a first continuous channel formed therein and surrounding said central opening, and where said first seal member is a continuous annular seal member received in said first continuous channel, and said inner face of said reflector has a second continuous channel formed therein surrounding said central opening and where said second seal member is received in said second channel.

11. The lighting assembly of 9, wherein said frame has a top flange overlying said light transmitting cover, a bottom flange coupled to said housing, and a side wall extending between said top flange and said bottom flange.

12. The lighting assembly of claim 11, wherein said inner face of said reflector has a first channel surrounding said central opening, and receiving said first seal member to form said seal between said reflector and said housing.

13. The lighting assembly of claim 12, wherein said outer face of said reflector has a second channel surrounding said central opening, and receiving said second seal member to form said seal between said reflector and said cover.

14. The lighting assembly of claim 13, wherein said reflector has an inwardly facing surface with a first end with an inclined reflecting surface and a second end with an inclined reflecting surface.

15. The lighting assembly of claim 14, wherein said inwardly facing surface of said reflector has a first reflecting side surface extending between said first end and second end, and a second reflecting side surface extending between said first end and second end, said reflecting side surfaces being substantially perpendicular to a plane of said reflector.

16. A lighting assembly comprising;

a housing having a front face;

at least one light source coupled to said front face of said housing;

reflector coupled to said front face of said housing and having a central opening surrounding said light source, an inner face and an outer face, said inner face coupled to said front face of said housing;

a first seal member positioned in a first channel between said inner face of said reflector and said housing forming a weatherproof seal, said first channel including a first rib;

a light transmitting cover overlying said outer face of said reflector and light source;

a second seal member positioned in a second channel between said reflector and said outer face of said cover forming a weatherproof seal, said second channel includes a second rib, wherein the second rib extends away from the first rib; and a frame having an inwardly extending flange with an inner edge forming a central opening and overlying an outer edge of said cover, and an outwardly extending flange coupled to said housing for coupling said cover and reflector to said housing.

17. The lighting assembly of claim 16, wherein said first opening and said second opening face in opposite directions.

18. The lighting assembly of claim 17, wherein wherein said first and second ribs are flexible and project toward its respective opening.

19. The lighting assembly of claim 18, wherein said at least one light source is a circuit board having a plurality of LEDs mounted thereon to form an LED array, and where said circuit board is coupled directly to said front face of said housing.

20. The lighting assembly of claim 19, wherein said central opening of said reflector defines a first inclined reflective surface at a first end of said reflector, a second reflective inclined surface at a second end of said reflector, a first side reflective surface extending substantially perpendicular to a plane of said reflector, and a second side reflective surface extending substantially perpendicular to the plane of said reflector.

* * * * *